United States Patent [19]

Langpaap et al.

[11] Patent Number: 4,547,163

[45] Date of Patent: Oct. 15, 1985

[54] OIL TRANSFER APPARATUS

[75] Inventors: Rudolf Langpaap, Hamburg; Konrad Wilke, Rosengarten, both of Fed. Rep. of Germany

[73] Assignee: LICENTIA Patent-Verwaltungs-G.m.b.H., Frankfurt am Main, Fed. Rep. of Germany

[21] Appl. No.: 385,282

[22] Filed: Jun. 4, 1982

Related U.S. Application Data

[63] Continuation of Ser. No. 156,094, Jun. 3, 1980, abandoned.

[51] Int. Cl.[4] ..... B63B 21/52

[52] U.S. Cl. ..... 441/2; 166/350

[58] Field of Search ..... 114/230, 270; 166/344, 166/341, 350, 338; 137/615, 236 OS; 141/279, 387, 388; 441/1-5

[56] References Cited

U.S. PATENT DOCUMENTS

| | | | |
|---|---|---|---|
| 3,148,653 | 9/1964 | Shatto | 114/144 |
| 3,336,572 | 8/1967 | Paull | 166/341 X |
| 3,458,853 | 7/1969 | Daniels | 166/341 X |
| 3,466,680 | 9/1969 | Schirtzinger | 441/5 |
| 3,677,310 | 7/1972 | Dobler | 141/388 X |
| 3,842,612 | 10/1974 | Arnold | 166/338 |
| 3,921,557 | 11/1975 | Kapteijn | 141/387 X |
| 3,975,784 | 8/1976 | Whitaker | 114/270 X |
| 4,047,579 | 9/1977 | Wilckens | 166/350 X |
| 4,080,025 | 3/1978 | Garnier | 166/343 X |
| 4,214,842 | 7/1980 | Franks | 166/341 X |
| 4,234,047 | 11/1980 | Mott | 166/350 |

FOREIGN PATENT DOCUMENTS

| | | | |
|---|---|---|---|
| 2505721 | 1/1976 | Fed. Rep. of Germany | 114/257 |
| 2717854 | 11/1977 | Fed. Rep. of Germany | 114/230 |
| 2381166 | 10/1978 | France | 114/230 |
| 143139 | 9/1980 | Norway | 441/4 |
| 2012715 | 8/1979 | United Kingdom | 441/4 |

*Primary Examiner*—Jesus D. Sotelo

*Attorney, Agent, or Firm*—Spencer & Frank

[57] ABSTRACT

An apparatus and method for transferring a fluid, such as oil, between a fluid conveying line and a ship. The apparatus includes a transfer unit anchored at the bottom of the sea and attached to the fluid conveying line, and a coupling device which is brought into the ship together with the transfer unit so that connections can be made to the coupling device at a weather resistant location within the ship. Fluid is transferred between the fluid conveying line and the ship via the transfer unit and coupling device.

14 Claims, 6 Drawing Figures

FIG.3
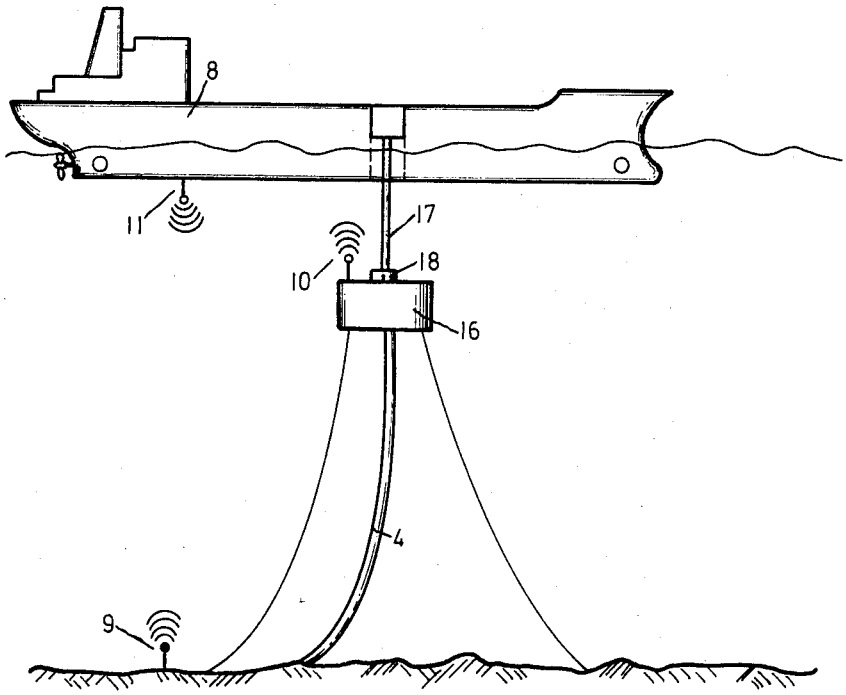
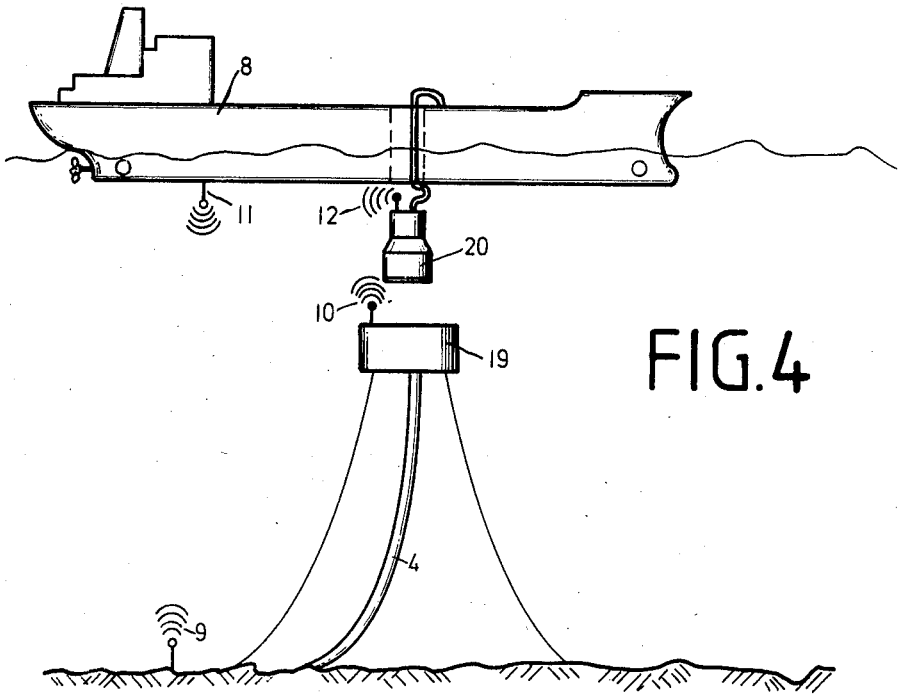
FIG.4

6
12
41
42
31
43
37
37
38
30
1
10
34
32
36
34
35
35
39
33
33
40
44
5
4
2
45

OIL TRANSFER APPARATUS

This is a continuation of application Ser. No. 156,094 filed June 3, 1980, now abandoned.

BACKGROUND OF THE INVENTION

This invention relates to apparatus for transferring fluid from a fluid conveying line into a ship and, in particular, to apparatus including a transfer unit and positionable coupling element for effecting transfer of oil into a tanker.

The use of increasingly larger tankers makes it more and more difficult to bring these ships into a harbor for the purpose of loading oil since frequently the water is not deep enough and maneuverability is decreased. For that reason, oil transfer systems have been developed which are positioned either in the immediate vicinity of oil production platforms or off the coast of oil producing countries.

A typical oil transfer system, which is connected with the platform or with the oil storage tanks on land by means of an oil conveying line, includes a buoy which floats freely on the surface of the water. In order to load the tanker, the oil line in the oil transfer system is connected with the line belonging to the tanker by means of a coupling mechanism. However, wind and high seas may produce considerable relative movement between the buoy and the tanker and, under adverse weather conditions, it is often impossible to establish a coupling for transfer of the oil. It has been found that due to their dependence on weather, known off-shore oil transfer systems can be utilized, on the average, only 65% of the time.

In order to overcome this drawback, Japanese Pat. No. 42-24698/1967 discloses the off-shore anchoring of an oil transfer unit which is connected with an oil conveying line in such a manner that the oil transfer unit normally floats at the surface of the water. When a tanker is to be loaded or unloaded, the transfer unit is lowered by appropriate signals transmitted from the ship or a control center over electrical power cables to underwater winches disposed at the anchoring location so that the tanker can be positioned above the transfer unit. Once the correct position has been attained, the transfer unit is brought into contact with the bottom of the ship by paying out or retracting the anchoring cables.

By making accessible the space in the transfer unit where the connecting studs are disposed, these studs can be connected to the studs in the ship by means of hoses. However, with this system, automatic coupling is impossible and, when at the surface of the water, the transfer unit is exposed to all of the disturbances occurring there and is thus endangered. Further, existing requirements for placing such systems into operation are not met.

French Pat. No. 70.35460 discloses a system in which an anchor provided with pipe studs is placed at the bottom of the sea. An oil conveying line is connected to the anchor and a hose is coupled to the studs by means of a connecting head. A buoy is fastened to the connecting head by means of a chain, and the hose, connecting head and buoy are disposed at the bottom of the sea.

A tanker which is to be loaded or unloaded is positioned at a given location with respect to these components of the system and transmits signals to the buoy which cause a balloon to be inflated and a cover broken causing the balloon to rise to the surface. The balloon, and with it the connecting head, are taken aboard the tanker and the connections required for the oil transfer process are then made. After completion of the loading or unloading process, a new buoy is attached to the connecting head and lowered into the water where it sinks to the bottom.

A significant drawback of this system is that the retrieval of the balloon is extremely difficult, at least under poor weather conditions. Moreover, if the weather is bad, the hose will be subject to great stresses once the connecting head has been taken aboard.

It is therefore an object of the present invention to provide an oil transfer apparatus which permits coupling the oil line to the tanker and thus permits utilization of the system under adverse conditions.

SUMMARY OF THE INVENTION

In accordance with the present invention, apparatus is provided for transferring fluid between a fluid conveying line and a ship which has an opening therein. A transfer unit is anchored at a predetermined depth below the surface of the water and is adapted for coupling to the fluid conveying line. A coupling unit is also provided which is insertable into the opening in the ship and is accessible at a location within the ship, the coupling unit connecting the transfer unit to the ship to permit the transfer of fluid through the transfer unit and coupling element between the fluid conveying line and the ship. Means are provided for positioning the ship and coupling element with respect to each other. In a typical application of the invention, the fluid is oil and the ship is a tanker.

A significant advantage of the apparatus according to the invention is that the coupling device between the tanker and transfer unit is substantially automated and the actual oil transfer between the tanker and oil conveying line occurs in a weather resistant area below the tanker's deck and thus is almost independent of weather conditions.

The invention also includes a method for transferring fluid between a fluid conveying line and a ship having an opening therein which comprises the steps of anchoring the transfer unit in water at a predetermined depth, connecting the fluid conveying line to the transfer unit, positioning the ship above the transfer unit at a predetermined location with respect to the transfer unit, moving the coupling device which is connected to the transfer unit into the opening in the ship, connecting the hose to the coupling device at a weather resistant location within the ship and transferring fluid between the fluid conveying line and the ship via the transfer unit, coupling device and hose.

BRIEF DESCRIPTION OF THE DRAWINGS

FIG. 3 shows apparatus in which the connection between the tanker and the transfer unit employs a telescopic riser.

FIG. 4 shows apparatus in which the connection is effected by the use of a coupling element lowered from and controlled by the tanker.

DESCRIPTION OF THE PREFERRED EMBODIMENTS

Figure 1:
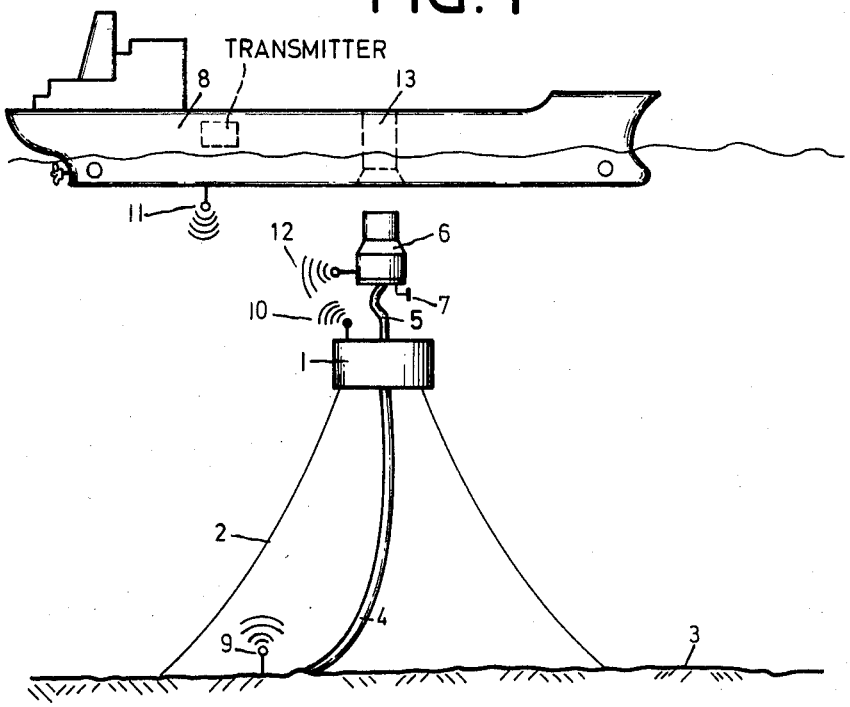
FIG. 1 shows an apparatus for transferring oil between an oil conveying line and a tanker which employs a coupling element having its own drive unit.

Referring to FIG. 1, there is shown apparatus for transferring oil which comprises an oil transfer unit 1 held at a predetermined depth above the bottom 3 of the sea by means of anchoring cables 2 and anchors (not shown). The unit 1 is connected with an oil conveying line 4 which is brought either from a production platform or from oil storage tanks. A coupling element 6 is held, via a flexible hose 5, at the transfer unit 1 and is movable within limits by means of, for example, three propeller drives 7, only one of which is shown in FIG. 1.

Figure 6:
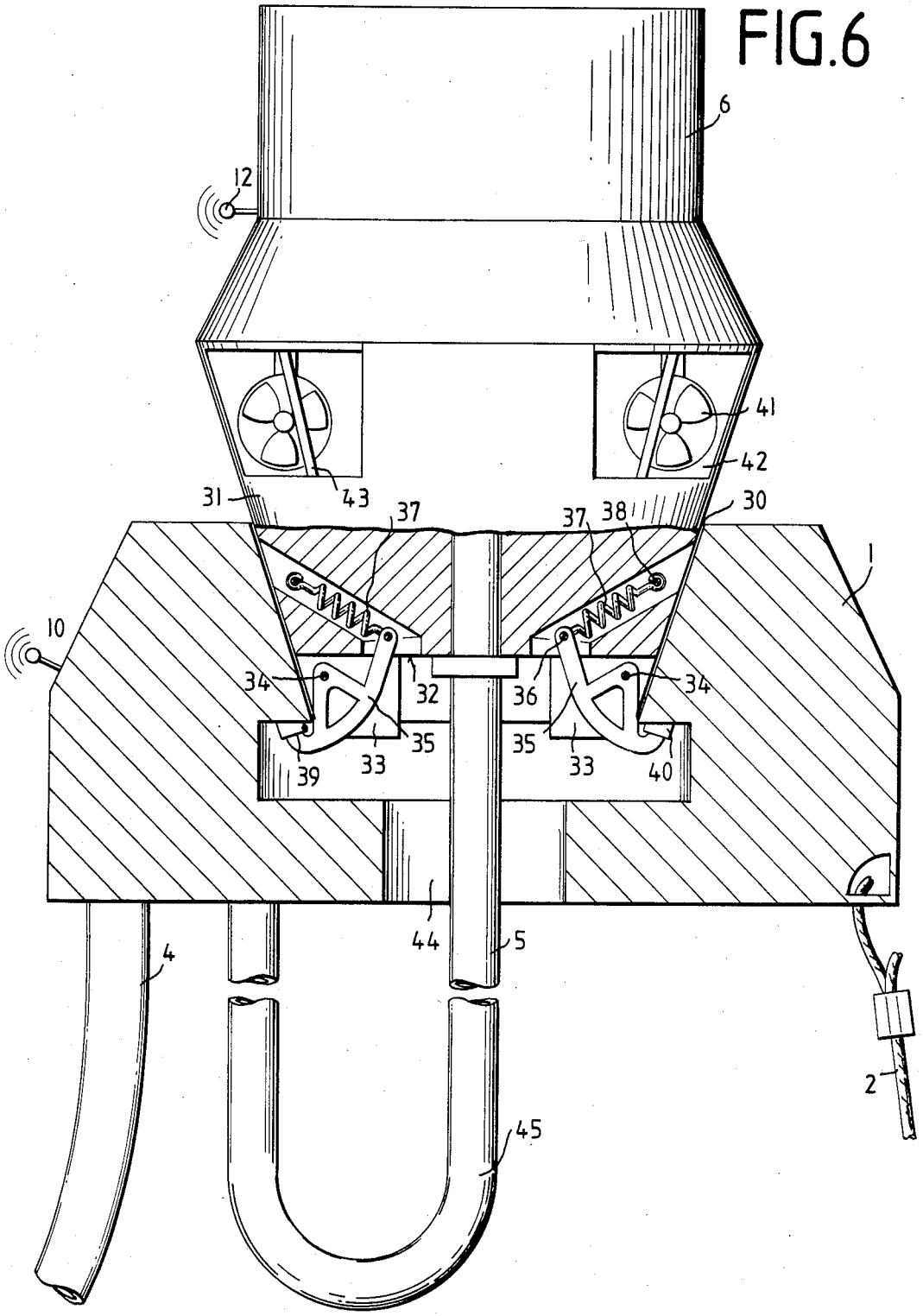
FIG. 6 shows the transfer unit and the coupling element coupled together.

If a tanker 8 is not positioned above the transfer unit 1, the coupling element 6 is secured to the transfer unit 1 as shown in more detail in FIG. 6. At the top of the transfer unit 1 there is an opening 30 in the form of a funnel. The lower conical part 31 of the coupling element 6 enters the opening 30 when the coupling element is joined to the transfer unit 1. At the lower position 32 of the coupling element 6 there are several niches 33 which contain curved links 35 that are rotatable around bolts 34. One end 36 of link 35 is attached to a compression spring 37 and the other end is attached to a supporting bolt 38 in the coupling element 6. The end 39 of the curved link 35 impinges on a stud 40 of the transfer unit 1 is held in this position by the force of the spring 37. Transfer unit 1 and coupling element 6 are thereby coupled tightly together.

The coupling element 6 employs several propeller drives 41 which are rotatable and swingable around an axis. The propeller drives 41 are distributed within a recess 42 and struts 43 are provided to increase their rigidity.

The transfer unit 1 and coupling element 6 are separated by retracting the links 35 from the studs 40 by means of electromagnetic or hydraulic drives (not shown) or in some other well known manner, the links rotating about their axes 34. The propeller drives 41 are brought into positions which permit upward movement of the coupling element 6. This element moves upwards and is controlled as it moves toward the opening in the tanker by positioning means 11 and 12.

One end of the flexible hose 5 is fastened to the coupling element 6 and the other end to the transfer unit 1. When element 6 and unit 1 are coupled, the hose 5 traverses opening 44 in the transfer unit and hangs in a loose bow 45 beneath the transfer unit 1. No special winding apparatus is needed.

The tanker 8 is dynamically positioned above the transfer unit 1 for the purpose of loading by a positioning system which maintains the position of the ship under the influence of external disturbing forces. This system employs hydrophones 9, 10, 11 and 12 which are attached at the bottom of the sea, and the transfer unit 1, at the tanker 8 and at the coupling element 6, respectively.

Such positioning systems are well known, especially in offshore techniques for positioning a platform above a well-head, positioning pipe-laying vessels above the intended path of a pipeline on the bottom of the sea and in other applications. A system of this type is disclosed in the Honeywell Inc., publication No. UG3M578 which describes an acoustic position indicator, and in U.S. Pat. No. 3,148,653.

Once the tanker 8 has reached its intended position, the coupling element 6 is steered into a receptacle 13 provided at the tanker. The guiding-in of the coupling element 6 is performed by the tanker 8 with the aid of the drive assemblies 7 which are supplied with energy by the transfer unit 1 or by the production platform. When the coupling element 6 is coupled to the tanker 8, its top lies above the water line so that the hose connection can be established manually. Upon completion of the loading process, the coupling element 6 is positioned back onto the transfer unit 1 with the aid of the position control means.

As in the positioning of ships, this system may also be used to guide the coupling element 6 back onto the transfer unit 1 as shown in FIG. 1. A system of this kind is described in the Honeywell Inc. publication UG 3M 578 discussed above.

Figure 2:
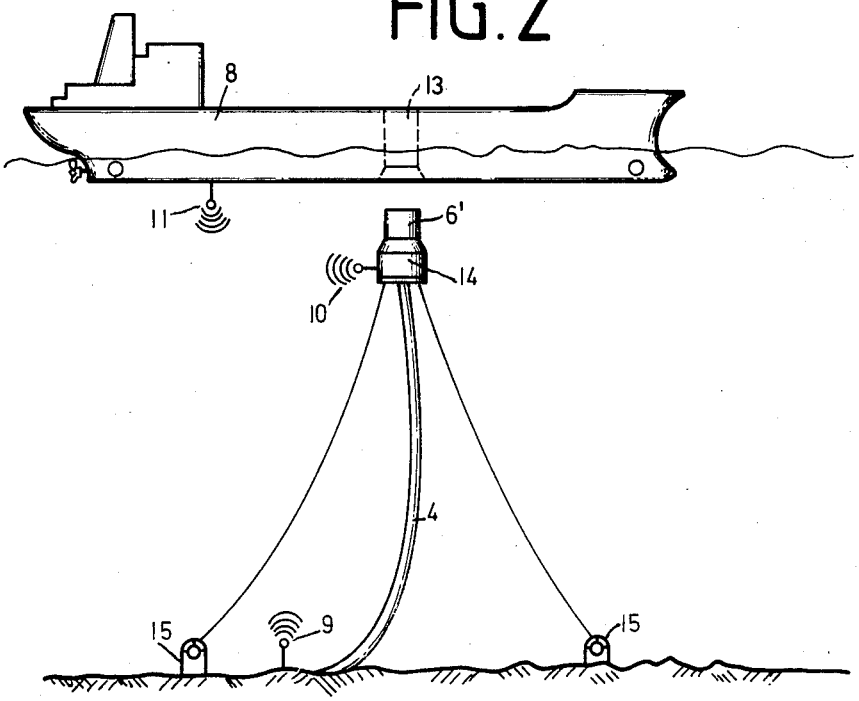
FIG. 2 shows an apparatus employing a transfer unit positioned by controlled winches.

A second embodiment of the invention is shown in FIG. 2 wherein the tanker has been brought into the loading position with the aid of a dynamic positioning system of the type described in connection with FIG. 1 and which includes hydrophones 9 and 11. A transfer unit 14, which is integrally connected to a coupling element 6', is positioned at any desired depth by means of underwater winches 15, the transfer unit being provided with a hydrophone 10 to aid in positioning.

When the tanker 8 and the coupling element 6' of the transfer unit 14 are properly positioned with respect to each other, the winches 15 are actuated by the tanker to move the coupling element 6' into the receptacle 13 so that the hoses on board the ship can be connected to the conveying line 4. Energy for the underwater winches is provided from the production platform.

Another embodiment of the invention is shown in FIG. 3. In this embodiment, the tanker 8 is brought into position with respect to the hydrophone 9 at the bottom of the sea and with respect to the firmly anchored transfer unit 16 which is likewise provided with a hydrophone 10. The connection between the tanker 8 and the transfer unit 16 is established by means of a telescopic connector 17 which engages a coupling element 18 in the transfer unit 16.

The telescopic connector 17 may be of the type used in deepwater drilling equipment, produced by Vetco Offshore, Inc., Ventura, Calif., U.S., as disclosed in their publication JRP 045, 1975, pages 24–29, the connection being shown between the riser which surrounds the hose-line on the wellhead. The connection is performed with the aid of a telescopic joint which lands in the wellhead. After latching in the wellhead the valves are opened hydraulically one after the other. A modified connector may be installed to combine the telescopic connector 17 and coupling element 18 with the transfer unit 16.

The telescopic connector can be used to compensate for fluctuations in depth as well as misalignment of the ship with respect to the transfer unit 16 and coupling element 18.

Still another embodiment of the invention is shown in FIG. 4, wherein a coupling element 20 is lowered from the tanker 8 after the tanker has been positioned with respect to the transfer unit 19. Coupling element 20 is positioned to couple with transfer unit 19 by means of the hydrophone 12 and steered by propeller drives (not shown). Energy for the drives of the coupling element is supplied from the tanker 8. After completion of the coupling process, oil can be transferred between the ship and conveying line 4.

Figure 5:
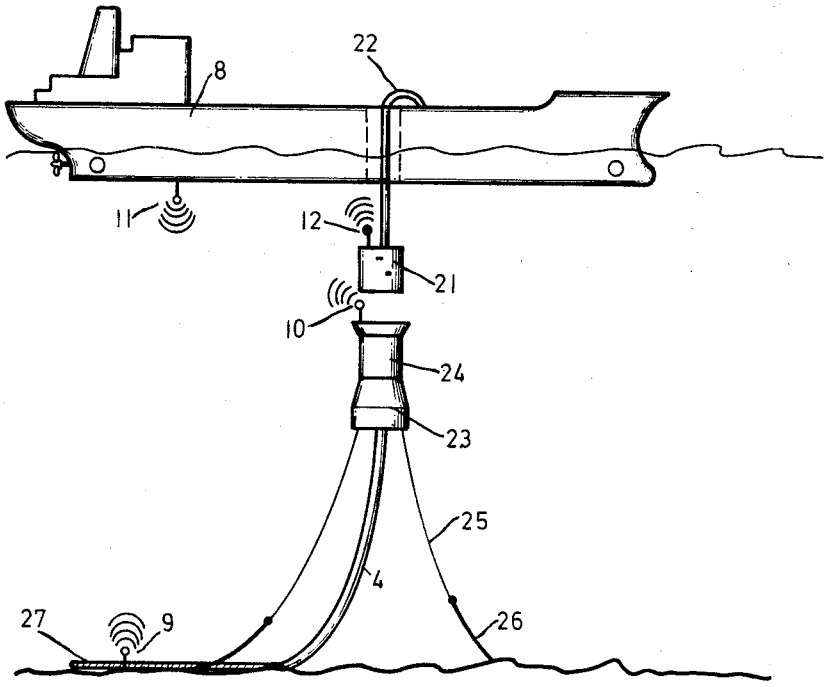
FIG. 5 shows apparatus employing a buoy dropped from and controlled by the tanker.

FIG. 5 depicts an arrangement in which the tanker, when in position, lowers a controllable buoy 21 having a propeller drive (not shown). A cable 22 connected to the buoy 21 transmits energy for the drive means of the buoy and the hydrophone 12 as well as for the transmittal of data. The transfer unit 23, which is permanently connected to coupling element 24, may be elastically anchored at a greater depth by means of cables 25 and chains 26, the top of coupling element 24 being typically about 30 meters below the bottom of the ship. The oil conveying line 4 connected with the transfer unit 23 is connected at its other end to a stationary pipeline 27. The hydrophone 9 for dynamically positioning the tanker 8 is disposed near the end of this pipeline.

After establishing the connection of the buoy 21 with the coupling element 24, the transfer unit 23 is pulled into the tanker with the aid of a winch, preferably a mooring winch. Then the loading line on board the tanker is connected to the oil conveying line 4.

It will be understood that the above description of the present invention is susceptible to various modifications, changes and adaptations, and the same are intended to be comprehended within the meaning and range of equivalents of the appended claims.

What is claimed is:

1. An oil transfer apparatus for transferring oil between an oil conveying line and an oil tanker, said oil tanker having an opening in the bottom thereof and being provided with a first hydrophone, said apparatus comprising:

a transfer unit having an opening in the top thereof, said transfer unit including means for connecting said transfer unit to said oil conveying line;

means for anchoring said transfer unit in the sea at a predetermined depth below the surface of said sea and above the bottom thereof;

a coupling element having a second hydrophone mounted thereon, said coupling element being insertable into the opening in said oil tanker to permit access thereto within said tanker, the lower portion of said coupling element mating with the opening in the top of said transfer unit for connecting said transfer unit to said oil tanker thereby permitting connections to be made to said coupling element at a weather resistant location within said oil tanker for transferring oil between said oil conveying line and said oil tanker; and positioning means affixed to said coupling element and cooperating with said first and second hydrophones for moving said coupling element from said transfer unit directly into the opening in said oil tanker.

2. Apparatus as defined in claim 1 wherein said coupling element is provided with at least one drive unit for the positioning of said element to establish a mechanical connection with said oil tanker.

3. Apparatus as defined in claim 2 wherein means are provided for lowering said coupling element from said oil tanker.

4. Apparatus as defined in claim 2 wherein said coupling element is coupled to said transfer unit by a flexible hose.

5. Apparatus as defined in claim 3 or 4 wherein said oil tanker is provided with a transmitter for positioning said coupling element with respect thereto.

6. Apparatus as defined in claim 1 which further comprises underwater winches connected to said transfer unit for the positioning thereof, said winches being positionable from said oil tanker.

7. Apparatus as defined in claim 1 which further comprises a telescopic riser for connection between said coupling element and said oil tanker.

8. Apparatus as defined in claim 3 or 2 wherein said transfer unit is anchored to the bottom of the sea by a cable or chain.

9. A method for transferring oil between an oil conveying line and a hose located within an oil tanker, said oil tanker having an opening therein, comprising the steps of:

anchoring a transfer unit in the sea at a predetermined depth below the surface of said sea and above the bottom thereof, said transfer unit having a coupling device connected therewith;

connecting said oil conveyor line to said transfer unit;

positioning said tanker above said transfer unit at a predetermined location with respect thereto;

sensing the relative position of said transfer unit with respect to said oil tanker;

moving said coupling device in response to the sensed relative positions of said transfer unit and said oil tanker directly into the opening in said tanker, oil transfer means for transferring oil from said transfer unit to said coupling device being provided therebetween;

connecting the hose located within said oil tanker to said coupling device, said connection being made at a weather resistant location within said tanker; and transferring oil between said oil conveying line and said tanker via said transfer unit, said coupling device and said hose.

10. The method defined by claim 9 wherein said coupling device is moved into the opening in said oil tanker by a propeller drive forming part of said device.

11. The method defined by claim 9 wherein said transfer unit and coupling device are integrally connected together, and wherein said connected transfer unit and coupling device are moved into the opening in said oil tanker by changing the depth at which said transfer unit is anchored.

12. The method as defined by claim 9 wherein said coupling device includes a telescopic connection which is moved into the opening of said oil tanker.

13. The method defined by claim 9 which includes the additional steps of lowering said coupling device from said oil tanker after said tanker has been positioned above said transfer unit, and connecting said lowered coupling device to said transfer unit prior to the step of moving said coupling device and transfer unit into the opening in said tanker.

14. The method defined by claim 9 wherein said transfer unit and coupling device are integrally connected together, and which includes the additional steps of lowering a buoy from said oil tanker after said tanker has been positioned above said integrally connected transfer unit and coupling device, and coupling said buoy to said coupling device prior to the step of moving said coupling device and transfer unit into the opening in said tanker. .

* * * * *